US005915359A

United States Patent [19]

Meyer et al.

[11] Patent Number: 5,915,359

[45] Date of Patent: Jun. 29, 1999

[54] METHOD AND SYSTEM FOR DETERMINING AND CONTROLLING A/F RATIO DURING COLD START ENGINE OPERATION

[75] Inventors: Garth Michael Meyer, Dearborn; Xiaoguo Tang, Canton; Joseph Richard Asik; Rogelio Garcia Samson, both of Bloomfield Hills; Daniel Lawrence Meyer, Dearborn, all of Mich.

[73] Assignee: Ford Global Technologies, Inc., Dearborn, Mich.

[21] Appl. No.: 08/851,396

[22] Filed: May 5, 1997

Related U.S. Application Data

[63] Continuation-in-part of application No. 08/768,002, Dec. 13, 1996, Pat. No. 5,690,072.

[51] Int. Cl.[6] ..... F02D 41/14

[52] U.S. Cl. ..... 123/436; 123/685

[58] Field of Search ..... 123/436, 443, 123/685; 701/113

[56] References Cited

U.S. PATENT DOCUMENTS

| | | | |
|---|---|---|---|
| 4,271,798 | 6/1981 | Seitz et al. | 123/436 |
| 4,622,939 | 11/1986 | Matekunas | 123/425 |
| 4,697,561 | 10/1987 | Citron | 123/339 |
| 4,780,827 | 10/1988 | Fujimori et al. | 364/431.07 |
| 5,211,011 | 5/1993 | Nishikawa et al. | 60/284 |
| 5,713,341 | 2/1998 | Leiseuring et al. | 123/694 |
| 5,774,823 | 6/1998 | James et al. | 701/110 |

FOREIGN PATENT DOCUMENTS

| | | |
|---|---|---|
| 03124909 | 5/1991 | Japan . |
| 05231136 | 9/1993 | Japan . |
| 05231137 | 9/1993 | Japan . |
| 05231138 | 9/1993 | Japan . |
| 05312026 | 11/1993 | Japan . |
| 06093845 | 4/1994 | Japan . |
| 063307741 | 11/1994 | Japan . |
| 07071234 | 3/1995 | Japan . |
| 07293233 | 11/1995 | Japan . |
| 07305644 | 11/1995 | Japan . |
| 07310534 | 11/1995 | Japan . |
| 08004522 | 1/1996 | Japan . |
| 08061052 | 3/1996 | Japan . |
| 08100639 | 4/1996 | Japan . |
| 08105318 | 4/1996 | Japan . |
| 08121147 | 5/1996 | Japan . |

OTHER PUBLICATIONS

"Fuel–Air Ratio Estimation From Cylinder Pressure In An Internal Combustion Engine", by Jeffrey C. Gilkey, May 1984.

"Internal Combustion Engine Fundamentals" by John B. Heywood, 1988, McGray–Hill, Inc.

"Real Time Engine Dynamic Analysis And Control", by Gottfried Hogh et al, SAE Paper No. 885104, pp. 2.81–2.90.

"Algorithms For Air–Fuel Ratio Estimation Using Internal Combustion Engine Cylinder Pressure", by Eric H. Gassenfelt et al, SAE Paper No. 890300, pp. 17–22.

"Air–Fuel Ratio Estimation In An Otto Cycle Engine: Two Methods And Their Performance", by R.S. Patrick, UMI Order No. 8925930, 1989.

(List continued on next page.)

*Primary Examiner*—Willis R. Wolfe
*Assistant Examiner*—Arnold Castro
*Attorney, Agent, or Firm*—Allan J. Lippa; Roger L. May

[57] ABSTRACT

A method and system for determining and controlling air/fuel ratio during engine cold start operation relies on applying a monotonically decreasing fuel pulse width modulation to the engine and synchronously measuring the effect of the modulation on related engine event periods. This effect is utilized in estimating air/fuel ratio, which is then compared to the desired air/fuel ratio. The difference between the estimated air/fuel ratio and the desired air/fuel ratio is used in controlling the air/fuel ratio to the desired air/fuel ratio.

20 Claims, 9 Drawing Sheets

OTHER PUBLICATIONS

"Estimate Of Indicated Torque From Crankshaft Speed Fluctuations: A Model For The Dynamic Of The IC Engine", by Giorgio Rizzoni, IEEE Transactions on Vehicular Technology, vol. 38, No. 3, Aug. 1989, pp. 168–179.

"Engine Control Using Cylinder Pressure: Past, Present, and Future", by J. David Powell, Journal of Dynamic System, Measurement, and Control, Jun. 1993, vol. 115, pp. 343–350.

"Engine Load And Equivalence Ratio Estimation For Control And Diagnostics Via Nonlinear Sliding Observers", by Minghui Kao et al, Int. J. of Vehicle Design, vol. 15, No. 3/4/5 1994, pp. 358–365.

"Methods For Internal Combustion Engine Feedback Control During Cold–Start", by Kenneth C. Leisenring et al, SAE Paper No. 950842, pp. 41–45.

"A/F Ratio Estimation And Control Based On Induced Engine Roughness", by Joseph R. Asik et al, Proceedings of the 1996 IEEE International Conference on Control Applications, Dearborn, MI, Sep. 15–18, 1996, pp. 781–785.

"A/F Ratio Estimation And Control Based On Induced Engine Roughness", by Joseph R. Asik et al, IEEE Control System, Dec. 1996, pp. 35–42.

EEC NN NORMALIZATION METHOD:

$$x_{norm} = \frac{x - \min(x)}{\max(x) - \min(x)}$$

METHOD AND SYSTEM FOR DETERMINING AND CONTROLLING A/F RATIO DURING COLD START ENGINE OPERATION

CROSS-REFERENCE TO RELATED APPLICATION

This application is a continuation-in-part of application entitled "Method and System For Determining And Controlling A/F Ratio in Lean Engines", filed Dec. 13, 1996, having U.S. Ser. No. 08/768,002, now U.S. Pat. No. 5,690,072.

TECHNICAL FIELD

This invention relates to methods and systems for estimating and controlling air/fuel ratio during engine cold start operation.

BACKGROUND ART

A considerable fraction of emissions from an internal combustion engine, perhaps as much as 80%, is generated during approximately the first 60 seconds of engine operation after the engine is started. There are two primary reasons for this. The first is that the catalyst is not yet functional and has low conversion efficiency, since it has not achieved its minimum threshold operating temperature of 300° C. to 350° C. The second reason is that the exhaust gas oxygen sensor used for feedback control of Air/Fuel (A/F) ratio is not yet functional, resulting in the need to use open loop or scheduled control rather than feedback control. Exhaust gas oxygen sensors may require as long as 60 seconds after power-on to become operational. Scheduled A/F ratio control is inherently less accurate than closed loop control because of variability and possible degradation in the functional characteristics of production components, leading to variability in system gains and dynamics.

During cold start (and even some hot start engine operation), the EGO sensor is not available or is not yet functional, resulting in the use of open loop or scheduled A/F control. Since accuracy under this condition is typically poor, it is desirable to improve the accuracy of open loop control to (1) reduce excessive emissions from excessively rich A/F operation (A/F<<14.65), and (2) reduce the occurrence of engine misfires and unstable operation from excessively lean A/F operation (A/F>>14.65).

Several different algorithms have been developed that estimate the A/F ratio for use in open loop or scheduled A/F control. These methods, however, require the use of an in-cylinder pressure sensor and high resolution crank angle calculations.

DISCLOSURE OF THE INVENTION

It is thus a general object of the present invention to provide a method to infer, estimate and control air/fuel ratio during engine cold start operation utilizing pre-existing engine sensors.

In carrying out the above object and other objects, features, and advantages of the present invention, a method is provided for estimating and controlling air/fuel ratio. The method includes the steps of sensing a cylinder air mass and generating a corresponding air mass signal. The method also includes the step of modulating a base fuel pulse width to the fuel injector according to a predetermined monotonically decreasing event schedule based on the air mass signal, the schedule including a rich fuel pulse width relative to the base fuel pulse width and a lean fuel pulse width relative to the base fuel pulse width. Still further, the method includes the step of determining a rich event time in response to the rich fuel pulse width and a lean event time in response to the lean fuel pulse width. The method finally includes the step of determining the air/fuel ratio based on the rich event time and the lean event time.

In further carrying out the above object and other objects, features, and advantages of the present invention, a system is also provided for carrying out the steps of the above described method. The system includes an air mass sensor for sensing a cylinder air mass and generating a corresponding air mass signal. Still further, the system includes control logic operative to modulate a base fuel pulse width to the fuel injector according to a predetermined monotonically decreasing event schedule based on the air mass signal wherein the schedule includes a rich fuel pulse width relative to the base fuel pulse width and a lean fuel pulse width relative to the base fuel pulse width, determine a rich event time in response to the rich fuel pulse width and a lean event time in response to the lean fuel pulse width, and determine the air/fuel ratio based on the rich event time and the lean event time.

Still further, an article of manufacture for an automotive vehicle is provided for carrying out the above object and other objects, features and advantages of the present invention. The automotive vehicle includes an internal combustion engine, a fuel injector for injecting fuel into the engine according to a base fuel pulse width, and an air mass sensor for sensing a cylinder air mass and generating a corresponding air mass signal. The article comprises a computer storage medium having a computer program encoded therein for modulating a base fuel pulse width to the fuel injector according to a predetermined monotonically decreasing event schedule based on the air mass signal, the schedule including a rich fuel pulse width relative to the base fuel pulse width and a lean fuel pulse width relative to the base fuel pulse width, determining a rich event time in response to the rich fuel pulse width and a lean event time in response to the lean fuel pulse width, and determining the air/fuel ratio based on the rich event time and the lean event time.

The above object and other objects, features and advantages of the present invention are readily apparent from the following detailed description of the best mode for carrying out the invention when taken in connection with the accompanying drawings.

BEST MODES FOR CARRYING OUT THE INVENTION

Figure 1:
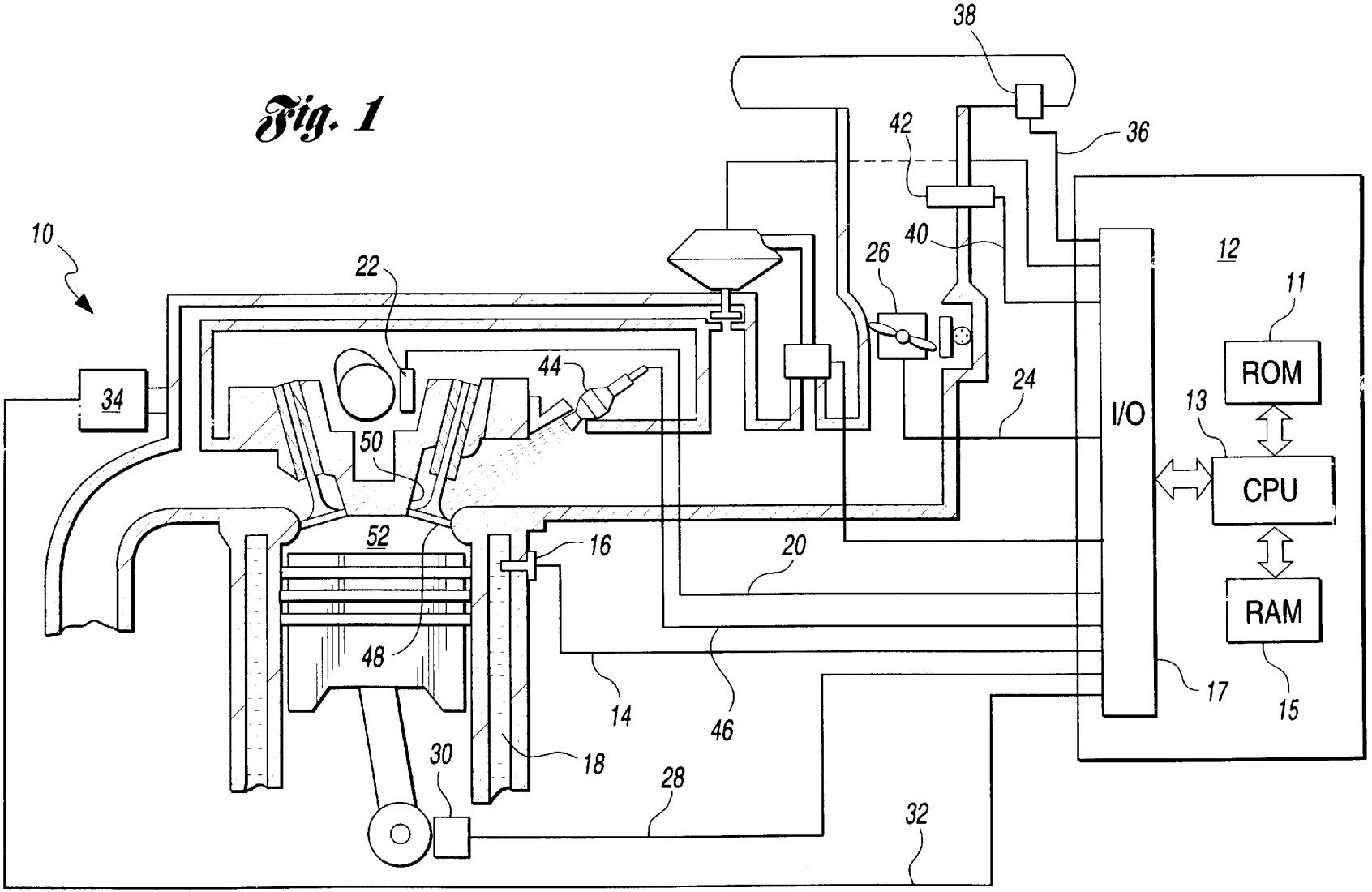
FIG. 1 is a block diagram of the system of the present invention.

Turning now to FIG. 1, there is shown an internal combustion engine which incorporates the teachings of the present invention. The internal combustion engine 10 comprises a plurality of combustion chambers, or cylinders, one of which is shown in FIG. 1 at 52. The engine 10 is controlled by an Electronic Control Unit (ECU) 12 having a Read Only Memory (ROM) 11, a Central Processing Unit (CPU) 13, and a Random Access Memory (RAM) 15. The ECU 12 receives a plurality of signals from the engine 10 via an Input/Output (I/O) port 17, including, but not limited to, an Engine Coolant Temperature (ECT) signal 14 from an engine coolant temperature sensor 16 which is exposed to engine coolant circulating through coolant sleeve 18, a Cylinder Identification (CID) signal 20 from a CID sensor 22, a throttle position signal 24 generated by a throttle position sensor 26, a Profile Ignition Pickup (PIP) signal 28 generated by a PIP sensor 30, a Heated Exhaust Gas Oxygen (HEGO) signal 32 from a HEGO sensor 34, an air intake temperature signal 36 from an air temperature sensor 38, and an air flow signal 40 from an air flow meter 42. The ECU 12 processes these signals received from the engine and generates a fuel injector pulse waveform transmitted to the fuel injector 44 on signal line 46 to control the amount of fuel delivered by the fuel injector 44. Intake valve 48 operates to open and close intake port 50 to control the entry of the air/fuel mixture into combustion chamber 52.

Figure 2:
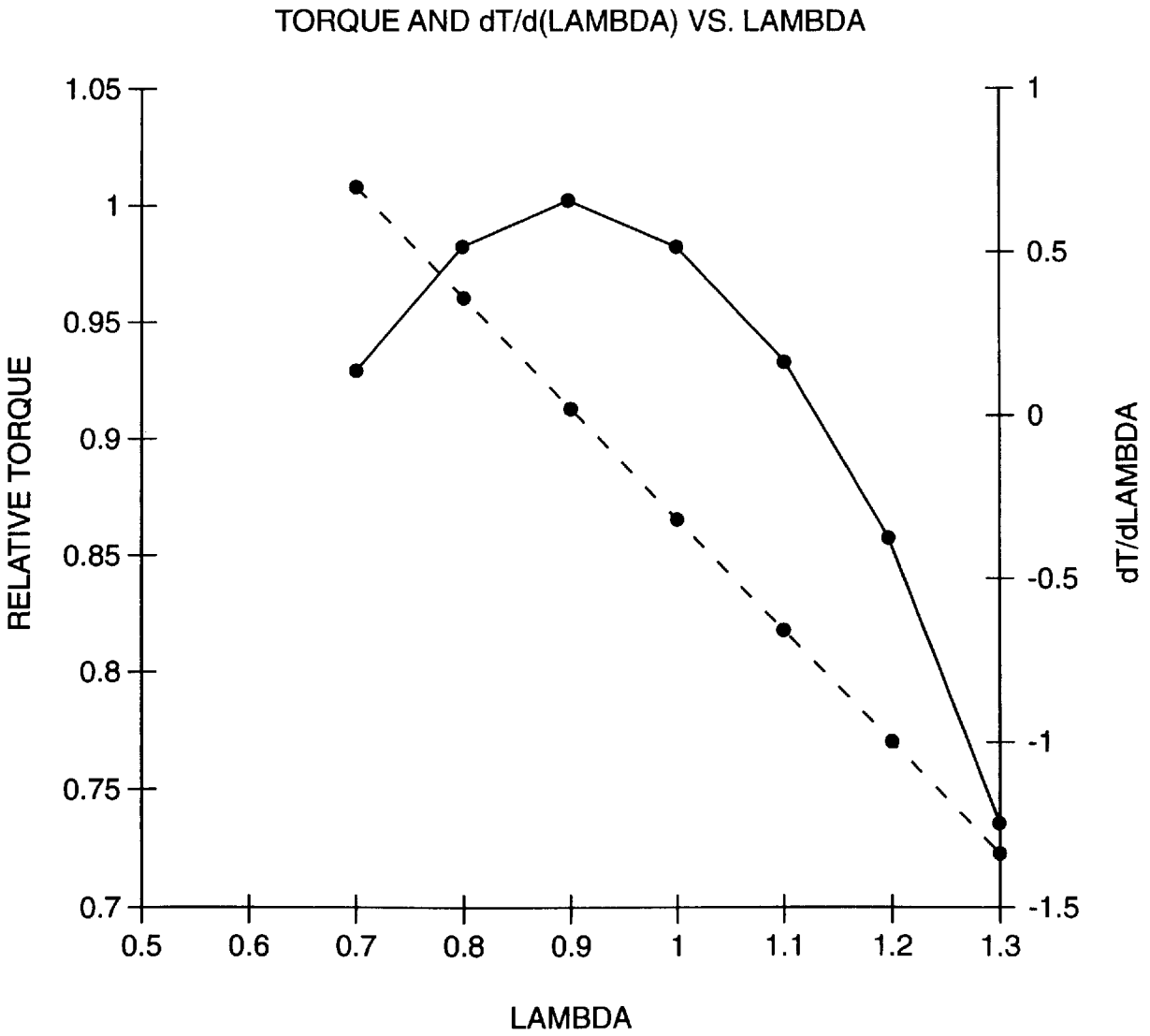
FIG. 2 is a graph illustrating the relationship between engine torque and dT/d(Lambda) vs. Lambda.

The torque of an internal combustion (IC) engine is a strong function of A/F ratio, with a peak in torque occurring at an A/F ratio of approximately 13:1 when gasoline is used as the fuel. It has a positive slope for A/F less than 13:1 and a negative slope for A/F greater than 13:1. Thus, the derivative of torque with respect to A/F resembles a line segment with a negative slope that passes through zero at A/F equal to 13:1 ($\lambda \approx 0.9$). This relationship is illustrated in FIG. 2. The use of this relationship, along with other engine variables, can be used to create an estimator with a high degree of accuracy for an engine A/F ratio. Since different speed/load points have different torque curves, account for this is taken by using engine state variables in addition to the metric in the A/F ratio estimator, as will be discussed below.

The basic relationship between the metric of the present invention and A/F will now be discussed. Engine torque T is proportional to angular acceleration, T a. Therefore, acceleration a is expanded as a function of A/F as follows:

$$a \approx a_o + \partial a/\partial(A/F) \cdot \delta(A/F). \quad (1)$$

The change in acceleration δa is given by:

$$\delta a = a - a_o = \partial a/\partial(A/F) \cdot \delta(A/F). \quad (2)$$

Since the A/F modulation amplitude, δ(A/F), in the combustion cylinder is maintained approximately constant for this method, $$\delta a \approx k \cdot \partial a/\partial(A/F) \approx \text{metric}. \quad (3)$$

In Equation (3), k is a proportionality constant. The metric is a key parametric input to the A/F estimator, and its measurement is discussed below. The function ∂a/∂(A/F) vs. A/F is a single valued function with a unique zero at A/F≈13, permitting absolute calibration of this function. The function ∂a/∂(A/F) is proportional to ∂T/∂(A/F), where T is the engine torque.

The metric used in this invention is given by:

$$metric = (N/1000)^3 \cdot \delta t, \quad (4)$$

where N is engine speed (rpm). $N^3$ normalization is required to calculate instantaneous change in angular acceleration δa from the instantaneous change in engine event time δt. The change in engine event time is calculated from the difference in event times: $\delta t = \Delta t_{L-\Delta tR}$, corresponding to lean and rich event times, respectively, for the 270° data capture windows, as will be described below.

Figure 3:
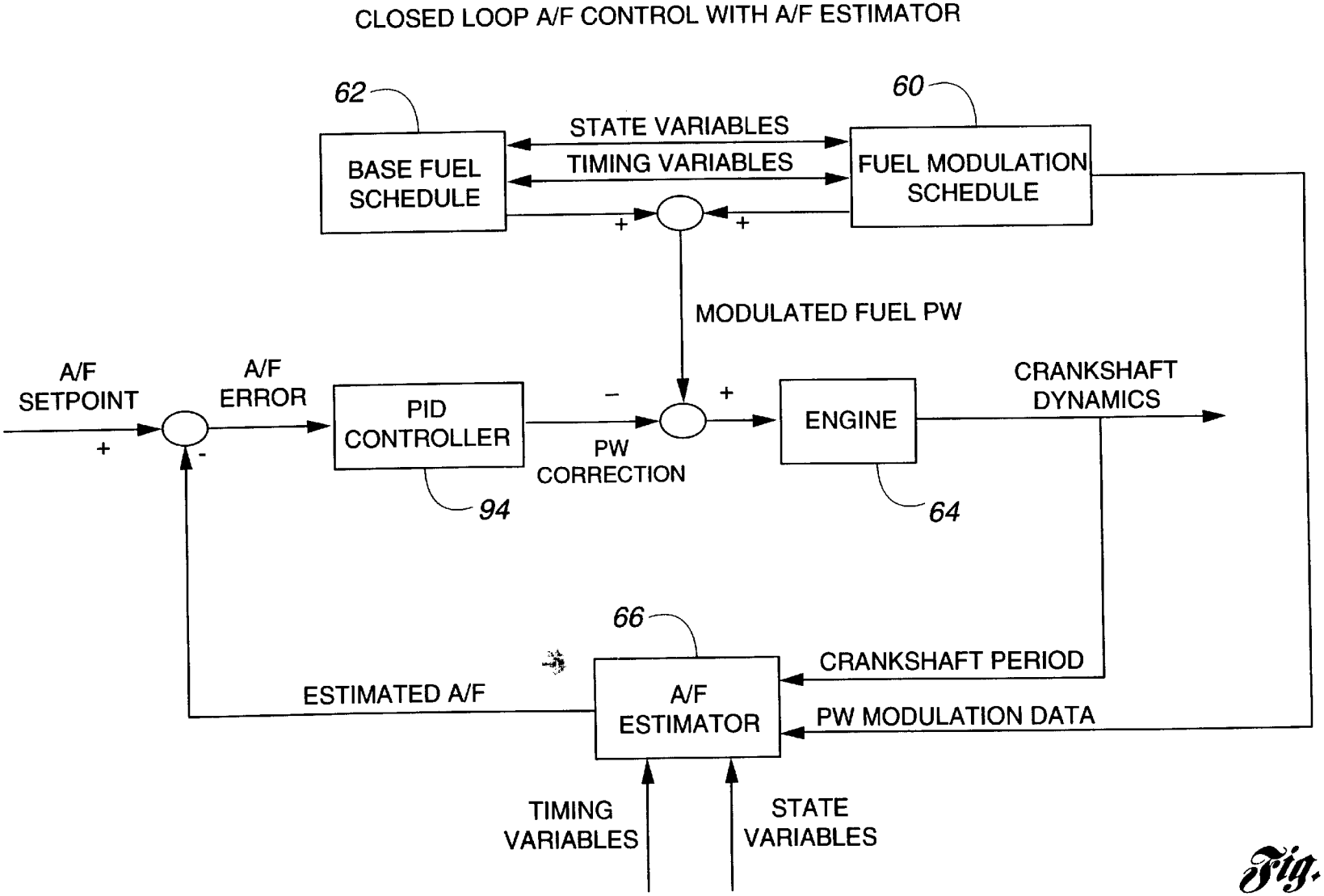
FIG. 3 is a simplified block diagram of the A/F estimator of the present invention.

A simplified diagram of the A/F estimator is shown in FIG. 3. A fuel modulation schedule 60 modifies a basic fuel pulse width 62 applied to the engine 64. Rich and lean events resulting from fuel modulation are measured and used to calculate the basic metric, which is derived from measurement of instantaneous crankshaft speed variations caused by modulating the fuel pulse widths. The metric, together with other state variables and pulse width timing information, comprise the inputs to the A/F estimator 66, which, in the preferred embodiment, is an artificial neural network, as will be described in greater detail below. However, regression equations could also be used. The output from the A/F estimator 66 is the instantaneous estimated A/F.

Figure 4:
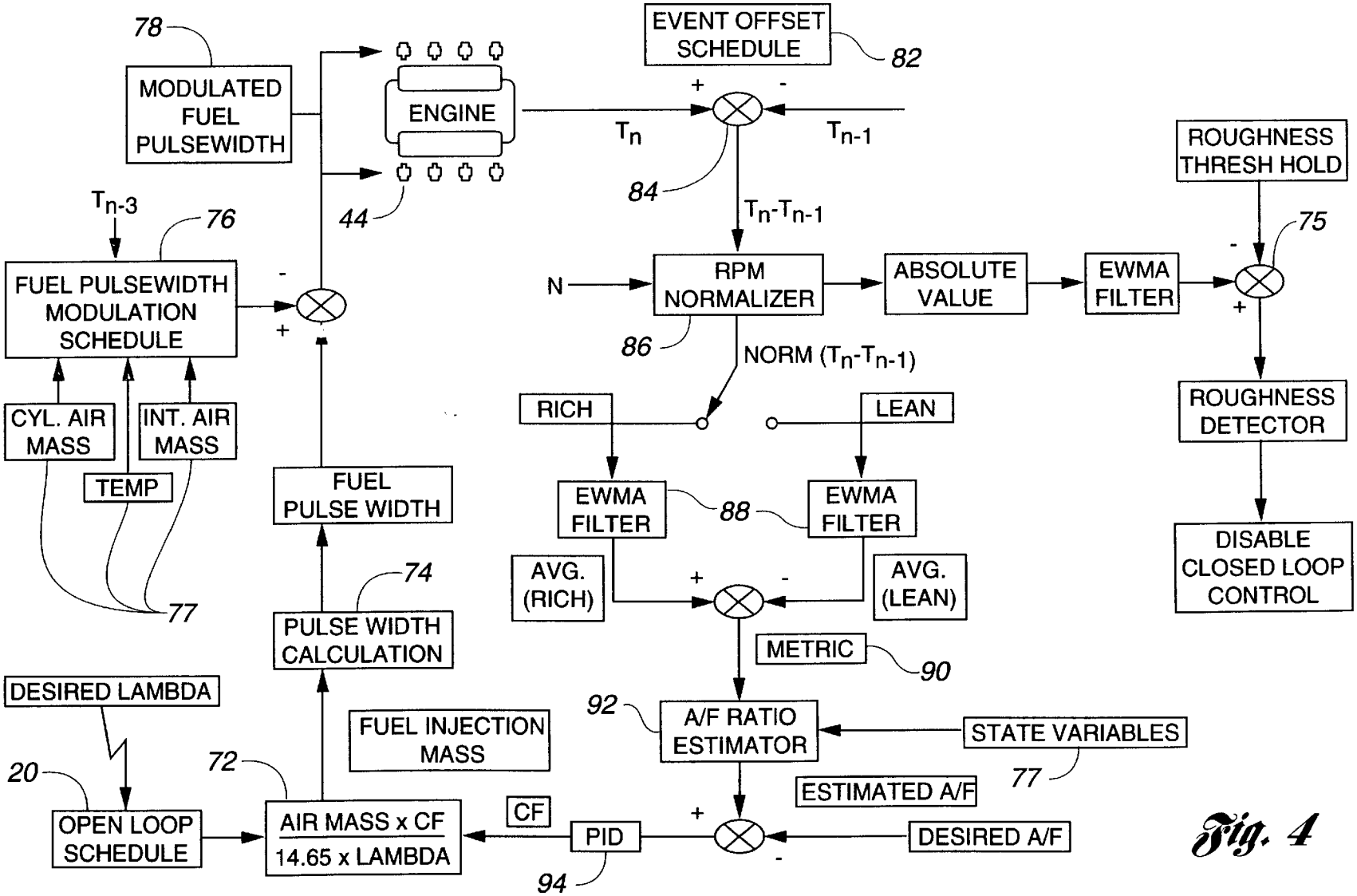
FIG. 4 is a more detailed block diagram of the A/F estimator of the present invention.
Figure 5:
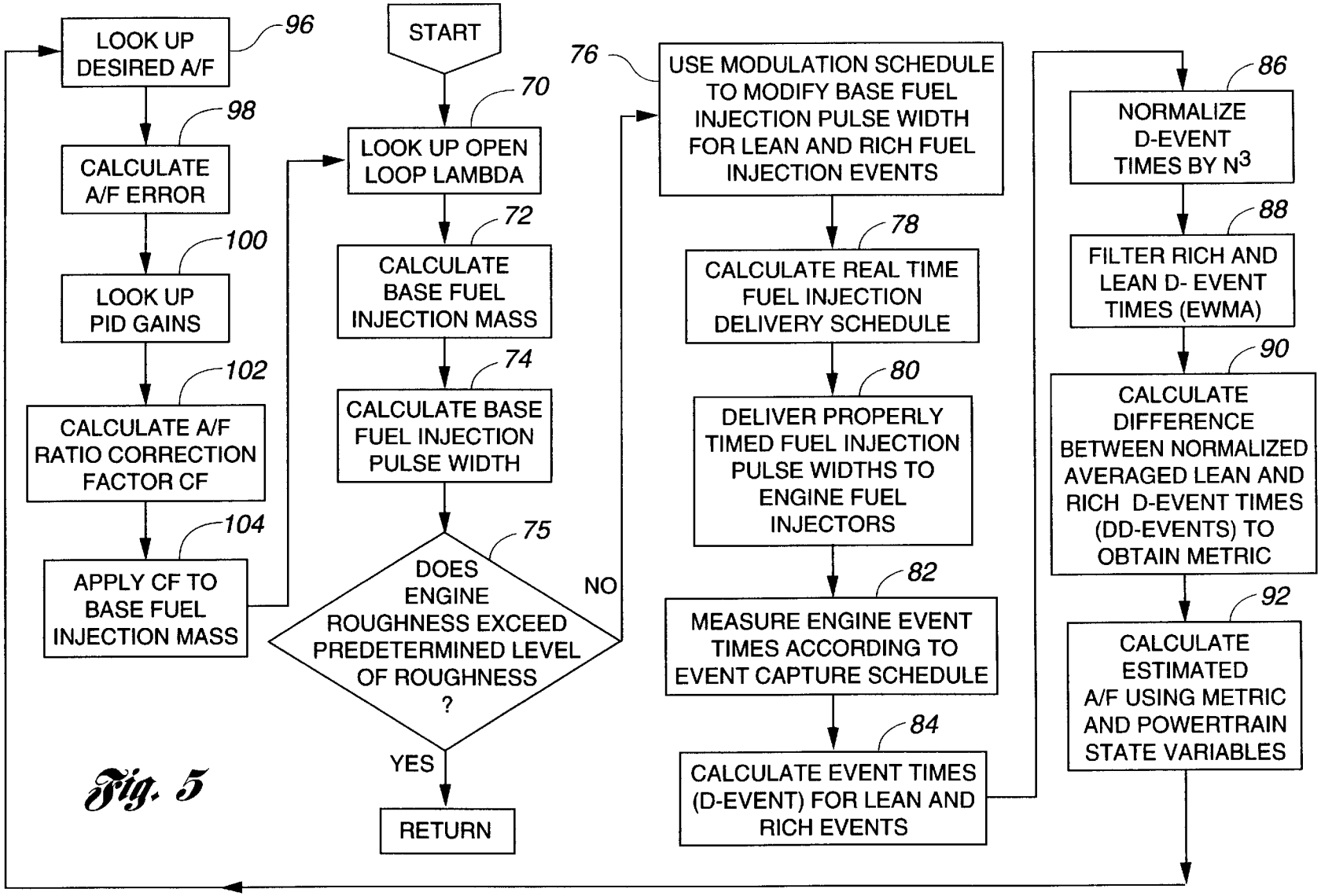
FIG. 5 is a flow diagram illustrating the general sequence of steps associated with the operation of the present invention.

The operation of the A/F ratio estimator and controller of the present invention will now be described in conjunction with the detailed block diagram of FIG. 4 and the flow diagram of FIG. 5, which illustrates a routine performed by a control logic, or the ECU 12. The ECU 12 may be comprised of hardware, software, or a combination thereof, as described above. Although the steps shown in FIG. 5 are depicted sequentially, they can be implemented utilizing interrupt-driven programming strategies, object-oriented programming, or the like. In a preferred embodiment, the steps shown in FIG. 5 comprise a portion of a larger routine which performs other engine control functions.

The method begins with the step of determining an open loop lambda, as shown at block 70. Lambda corresponds to A/F ratio with respect to stoichiometry, i.e., lambda equals (actual A/F ratio/14.65), where 14.65 corresponds to stoichiometric A/F ratio for typical gasoline. Next, a base fuel injection mass is determined, as shown at block 72. The base fuel injection mass is determined in accordance with the following: Base Fuel Injection Mass=(Air Mass)/(14.65× Lambda), where Air Mass, known as the cylinder air charge, corresponds to the mass flow rate of incoming air as indicated by the air flow signal 40.

A base fuel injection pulse width is then determined based on the base fuel injection mass, as shown at block 74. The base fuel injection pulse width corresponds to the base fuel injection mass adjusted for time and the flow characteristics of the fuel injector 44.

Next, the method preferably proceeds to determine if the current level of engine roughness exceeds a predetermined level of roughness, as shown at conditional block 75. The predetermined level of roughness corresponds to a maximum level of roughness the vehicle can withstand before reaching instability. One method for determining a level of engine roughness is disclosed in co-pending patent application entitled "Method and System for Controlling Combustion Stability for Lean-Burn Engines," filed Dec. 13, 1996, having U.S. Ser. No. 08/768,001. If the engine roughness, as sensed by the variation in engine periods, exceeds the predetermined roughness threshold, the routine is exited. If not, the method proceeds to apply a modulation schedule to the base fuel injection pulse width, as shown at block 76.

Figure 6:
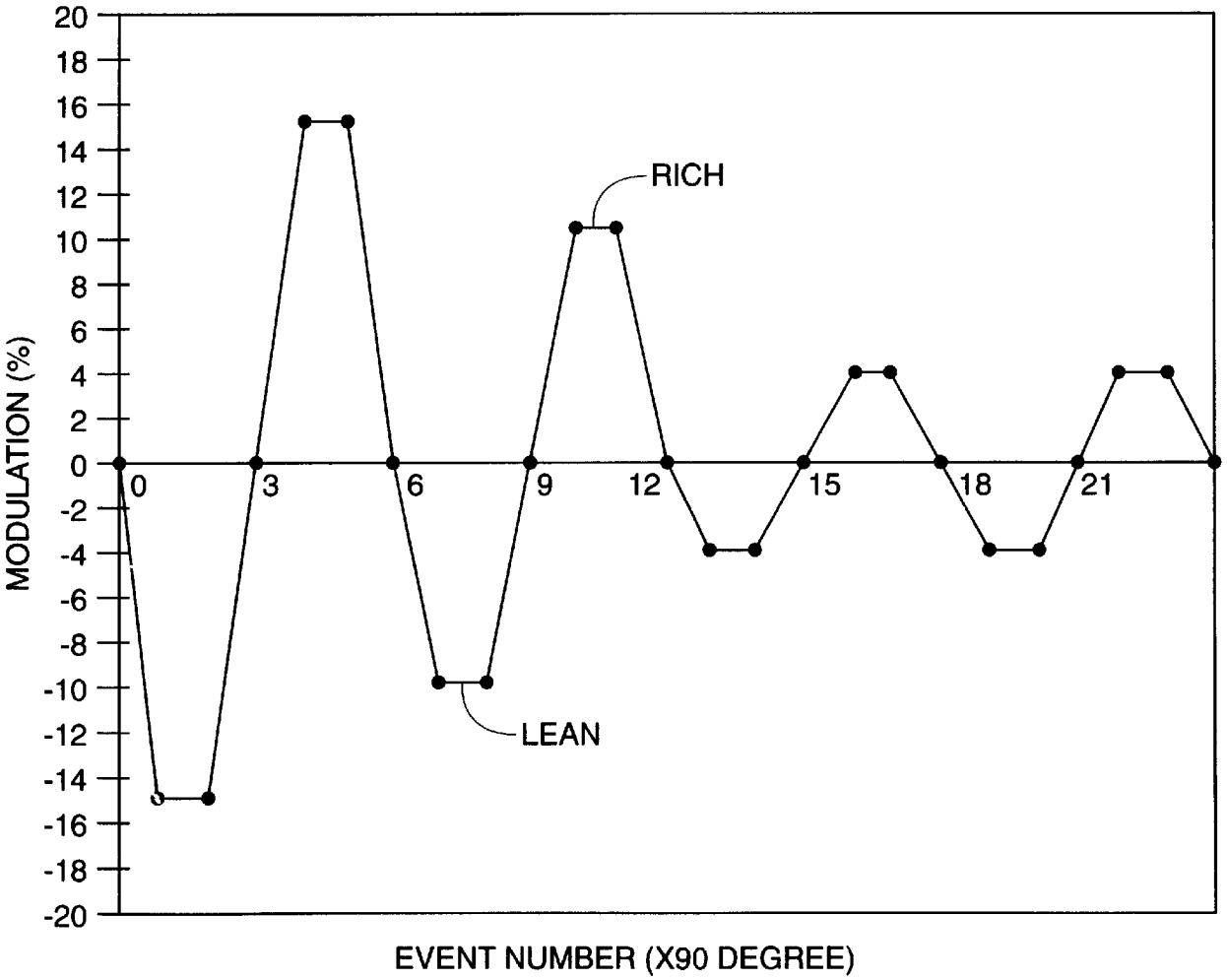
FIG. 6 is an example of a predetermined modulation schedule utilized in the method of the present invention.

The modulation schedule is determined based on state variables 77, such as engine coolant temperature, cylinder air charge mass, and integrated engine air mass. The amplitude of the fuel injection pulse width modulation is varied with engine coolant temperature (ECT (° F.)) and integrated engine air mass (ami). This function slowly decreases the differential modulation amplitude from approximately ±15% at ECT=70° F. and ami=0 to±4% for ami≧0.6 and ECT≈75° F. This latter condition corresponds to pseudo-stabilized operation of the engine. The purpose of this function is to compensate for the wall wetting phenomenon in which a portion of the injection fuel mass is deposited as a fuel film on the intake manifold wall. The mass of fuel in the film decreases as more air is combusted in the cylinders, increasing the engine temperature. The result of this fuel modulation amplitude compensation function is to produce a constant amplitude A/F modulation within each engine cylinder during the engine warm up and operating cycles. This function is similar to the conventional cold engine fueling compensation function. The fuel injection pulse width modulation is varied according to a predetermined monotonically decreasing event pattern. An example of a predetermined modulation schedule for an eight cylinder engine is shown in FIG. 6, in which two rich fuel injection events and two lean fuel injection events are alternated around the base fuel injection pulse width. The fuel pulse widths are applied to engine in a sequential fuel injection pattern. The magnitude of this modulation is small enough that it has not been observed to affect either the closed loop control performance or the engine emissions. The real time delivery schedule of the fuel injection pulse widths is determined at block 78, followed by the actual delivery of the fuel injection pulse widths to the fuel injector 44 at block 80.

Figure 7:
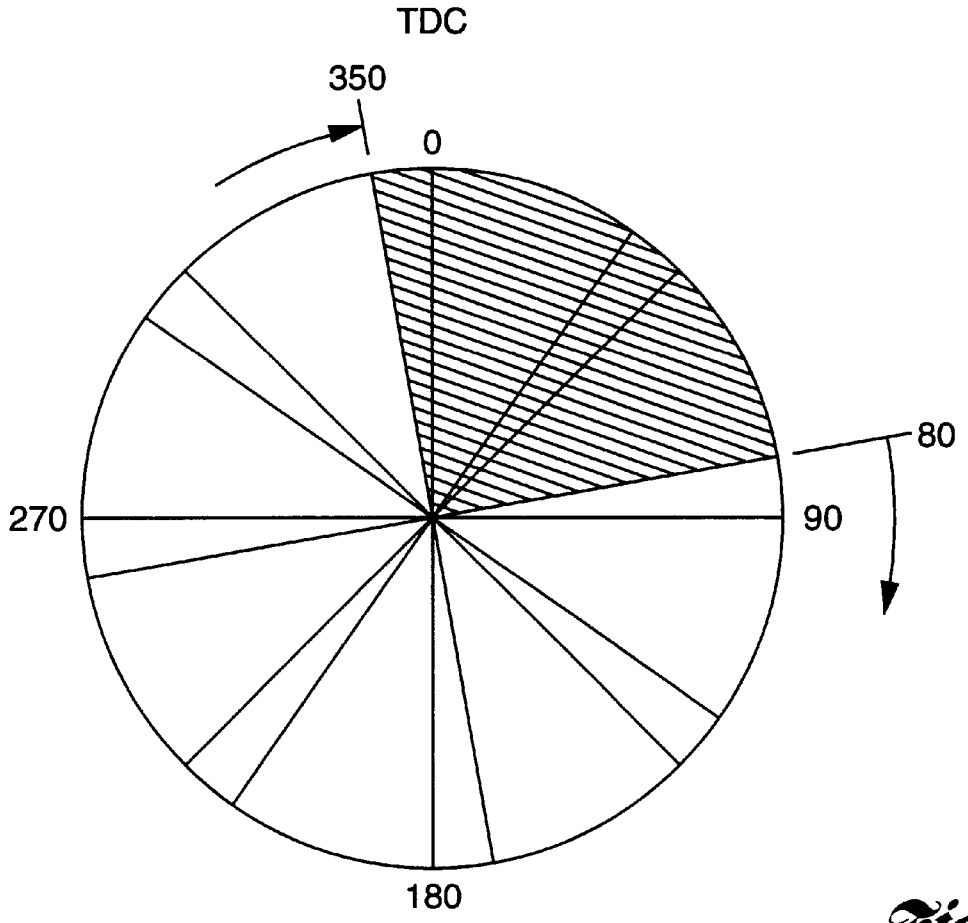
FIG. 7 is a chart illustrating the capture window for a typical eight cylinder engine event.

Next, the engine event times $T_n$ are measured according to an event capture schedule, as shown at block 82. FIG. 7 is a chart illustrating a capture window for a typical engine event. The capture window width of 270 degrees starts at 80 degrees After Top Dead Center (ATDC) and ends at 10 degrees BTDC (before TDC). The capture window is large to allow for wide variations in spark advance and combustion torque characteristics. The size and location of the capture window may be varied for different engines and operating conditions. Spark retard affects the shape of the torque curve and also delays the angle of the peak in torque from about 15 degrees ATDC to significantly later. A first capture window for engine events is set up after a pair of rich fuel pulse widths and a second capture window is set up for engine events occurring after a pair of lean fuel pulse widths.

Once the capture start period begins, a first timer value is captured. A second timer value is then captured at the end of the capture window. These two times for each window are used to determine the event times, $T_{lean}$ (or $\Delta t_L$) and $T_{rich}$ (or $\Delta t_R$), or partial metrics, for the lean and rich events, respectively. The time difference between the lean and rich capture windows is then calculated, as shown at block 84. The partial metrics are then normalized for rpm by multiplying by $N^3$, as shown at block 86, and passed through exponentially weighted moving average (EWMA) filters, as shown at block 88. An $N^3$ normalization is used in order to calculate an instantaneous change in angular acceleration from the instantaneous change in engine event time. Depending on the status of the engine 10, the processor 12 determines the gain and location of the averaging filters to produce the most useful metric and A/F ratio estimate.

The event times are calculated and filtered in order to statistically remove timing variations not caused by fuel modulation. By averaging two uniformly distributed samples at a population differentiated only by the state of fuel modulation, other variations cancel out. Variations cancelled include timing mark registration errors, cylinder air charge differences, injector flow rate differences, cylinder temperature, cylinder deposits, compression ratio, cylinder burn rate, etc. The difference between the lean and rich filtered partial metrics is then calculated, as shown at block 90, to obtain the final metric, $(N/1000)^{3*}\ \delta T$, which is used as an input to artificial neural networks or the regression equations of the A/F ratio estimator 92 to obtain the estimated A/F ratio.

The metric is derived as follows. Consider reference rotational timing marks for an engine separated by equal angular segments Ae. The measured angular velocities of two selected segments, respectively, are $$\omega_L=\Delta\theta/t_L \text{ and } \omega_R=\Delta\theta/\Delta t_R,$$

where the measured time intervals between two successive angular segments are $\Delta t_L$ and $\Delta t_R$, corresponding to capture windows for lean (L) and rich (R) events, respectively. The average angular acceleration $a_L$ from a normal to a lean event is given by $$a_L=(\omega_L-\omega_0)/\Delta t_{OL}=2(\omega_L-\omega_0)/(\Delta t_L+\Delta t_0).,$$

since $\Delta t_{OL}\approx\Delta t_L/2+\Delta t_O/2$. $\omega_O$ corresponds to the angular velocity during the normal event $\Delta t_O$. Defining $\Delta t_L=\Delta t_L-\Delta t_O$, we find $$a_L=-N^3\delta t_L/(\Delta\theta)^2,$$

since $\Delta t_L\approx\Delta t_O=\Delta\theta/N$. The average angular acceleration $a_R$ from a normal to a rich event is given by $$a_R=2(\omega_R-\omega_O)/(\Delta t_R+\Delta t_O)=-N^3\delta t_R/(\Delta\theta)^2,$$

where $\delta t_R=\Delta t_R-\Delta t_o$ and $\Delta t_R\approx\Delta t_O=\Delta\theta/N$. The difference in acceleration $\delta a$ between lean and rich events is given by $$\delta a=a_R-a_L=N^3\delta t/(\Delta\theta)^2,$$

where $\delta t=\Delta t_{L-\Delta tR}$. Thus, $\delta a\ \alpha N^3*\delta t$. For our case of an 8 cylinder engine, $\Delta\theta$ was chosen equal to 270° or $3\pi/2$, the capture window described in FIG. 7.

As discussed above, the method proceeds to estimate the A/F ratio based on the metric and powertrain state variables. One estimator used is a four parameter equation-based estimator as follows:

$$\text{Estimated A/F Ratio}=C_0+C_1{*}\text{metric}+C_2{*}\ (\text{metric}{*}\text{spk})+C_3{*}\ (\text{load}{*}\text{spk}),$$

where $C_n$ are constants empirically selected through data modeling, spk equals spark advance (degrees before top dead center), and load equals normalized cylinder air mass. Typical values for the constants are $C_0$=13.08, $C_1$=0.01511, $C_2$=0.0004184, and $C_3$=0.02195. This estimator was identified from steady state operation of the engine at A/F ratios at and very near to stoichiometry, and is predominantly linear in the metric. However, additional non-linear cross terms, such as those dependent on (metric*spark) and (load*spark), are present. The (metric*spark) term accounts for the strong change in engine torque and metric with spark advance. The (load *spark) term accounts for the change in engine torque with spark advance and load.

More complex A/F estimators based on regression analysis and on the use of artificial neural networks can also be used. A second, more complex estimator, derived from regression analysis, is as follows:

$$\text{Estimated } A/F \text{ Ratio} = C_0 + C_1 * N + C_2 * N^2 + C_3 * \text{metric} + C_4 * \text{metric}^2 + C_5 * spk^2 + C_6 * (\text{load} * spk) + C_7 * (fuelpw * ect) + C_8 * (ami * tot) + C_9 * (\text{load} * iscdty),$$

where N equals rpm, fuelpw equals fuel pulse width, ect equals engine coolant temperature, ami equals (clipped) integrated cylinder air mass, tot equals transmission oil temperature and iscdty equals idle speed duty cycle. Typical values for the constants are $C_0$=9.305, $C_1$=0.004288, $C_2$=−2.855X$10^{-6}$, $C_3$=0.007105, $C_4$=−1.275X$10^{-5}$, $C_5$=−0.0004005, $C_6$=0.07636, $C_7$=1. 397×$10^{-5}$, $C_8$=0.01401, and $C_9$=6.2886.

The fundamental engine variables, N, metric, load, and spark again appear in this estimator. In addition, the variables fuelpw and iscdty are present to provide improved transient accuracy. The temperature values ect and tot provide improved accuracy for changes in engine temperature. In particular, tot accounts for temperature dependent viscosity effects associated with the automatic transmission torque converter. The variable ami is included since it provides an improved indication of intake port and valve temperature during the engine warm up period when compared to ect. If an engine intake port temperature sensor were available, it could be used instead of ami. The maximum value of ami is clipped to 2.0 lbm, so its effect occurs only during the first few minutes of cold start. The cross-term fuelpw*ect accounts for cold start A/F enrichment.

Figure 8:
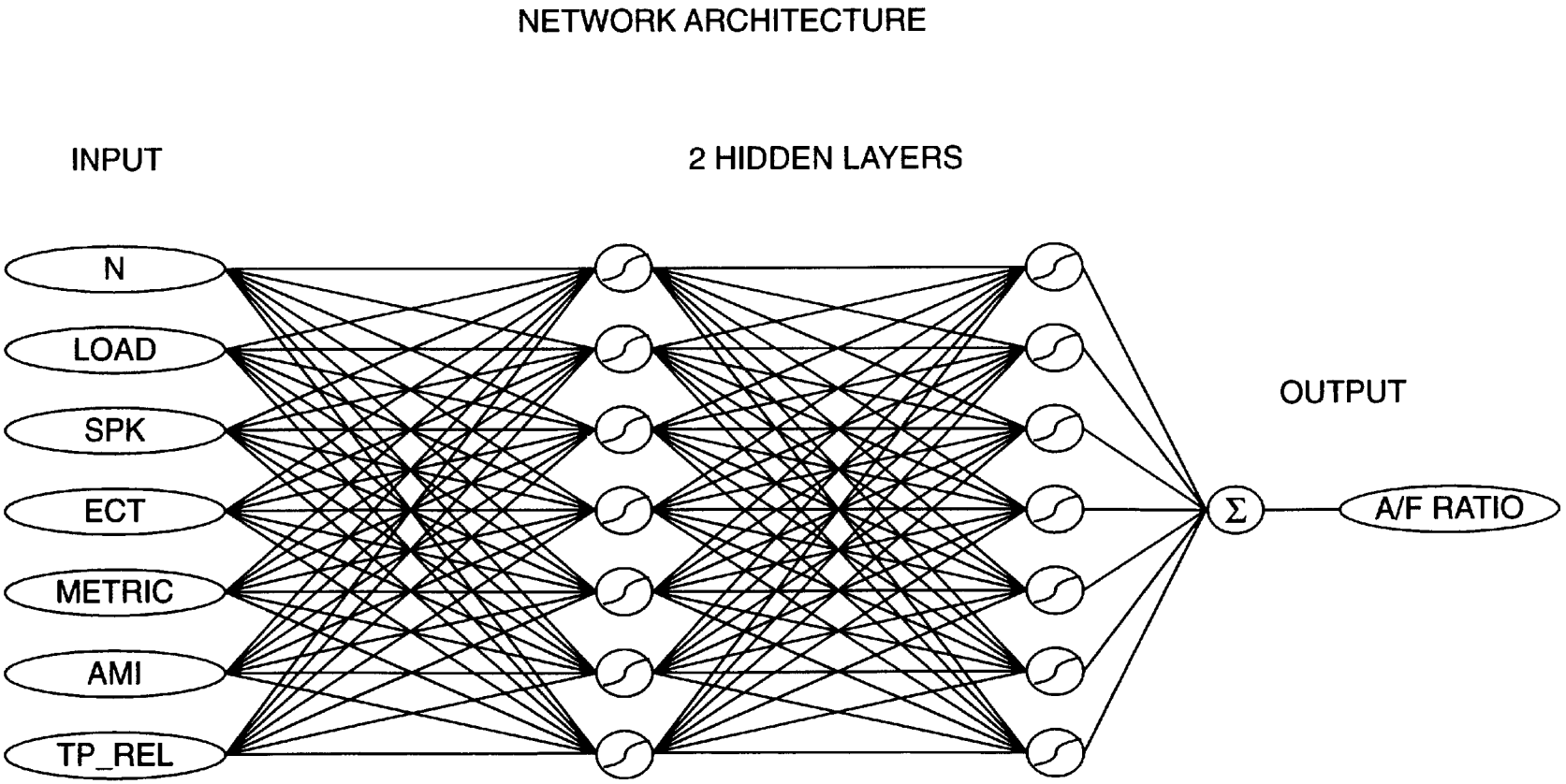
FIG. 8 is a block diagram of an artificial neural network estimator utilized in the method of the present invention.

A third estimator uses an artificial neural network, such as the type shown in FIG. 8, having two hidden layers where the seven inputs are N, load, spk, ect, metric, ami, and $tp_{13}$rel (relative throttle position). The neural network is trained on actual engine vehicle data using conventional backpropagation training algorithms.

Figure 9:
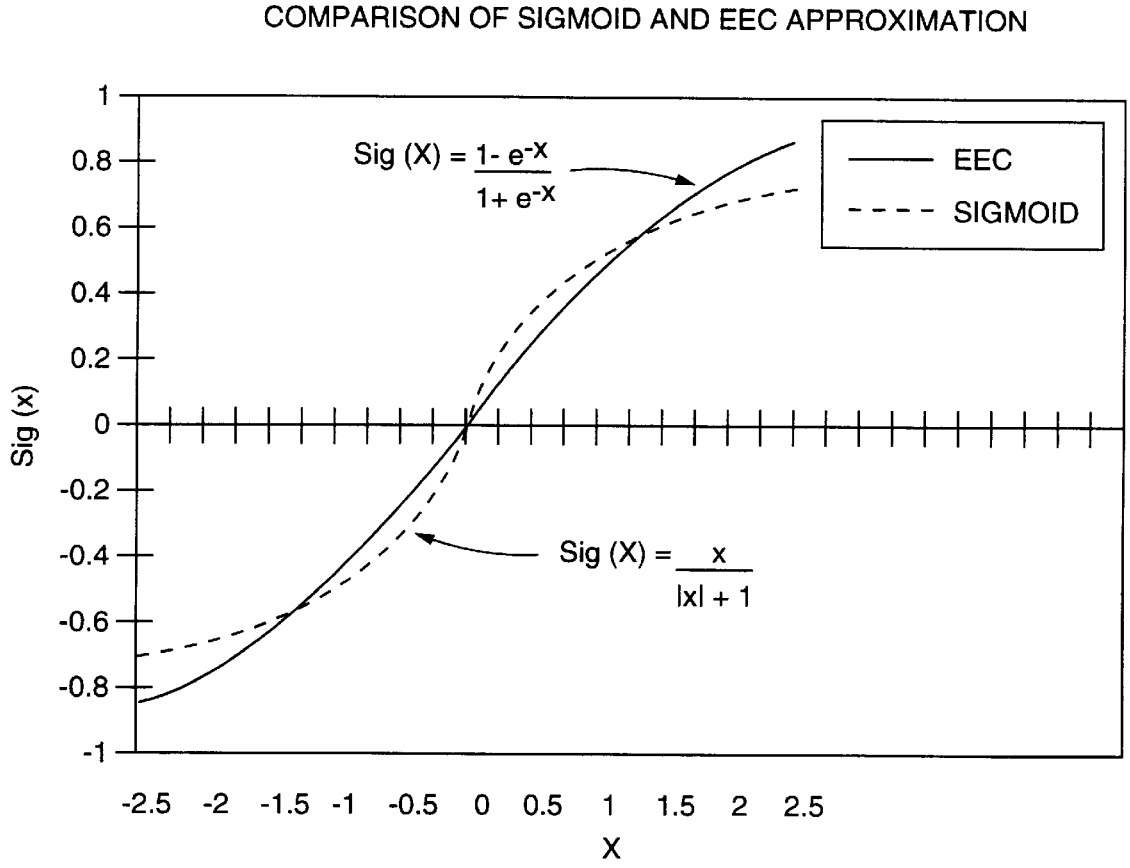
FIG. 9 is a graph illustrating a conventional sigmoid function used as a node in the artificial neural network of FIG. 8.

At each node, the input is $W_1X_1+W_2X_2+\ldots+W_7X_7+B$, where X is the input, W is a weight assigned to each input at that node, and B is a node bias. The output of a node is a sigmoid applied to the input. The output node is linear. Altogether, there are 110 weights and 15 biases in this design. The neural network was trained on several sets of stoichiometric (A/F≈15), lean (A/F≈16.5), and rich (A/F≈13.5) data. Lean and rich offsets from nominal stoichiometric calibration was achieved through a software multiplier. FIG. 9 illustrates a conventional (mathematical) sigmoid function used as a node in the neural networks, together with a bilinear approximation to the sigmoid as actually applied in an electronic engine controller (EEC). The normalization algorithm for EEC application is also illustrated.

Any of these estimators, all of which utilize the fundamental metric based on fuel pulse width modulation, can be used in a closed loop A/F ratio control system in which the error generated between a desired A/F ratio and the estimated A/F is applied to a conventional PID (proportional-integral-differential) controller 94 (FIGS. 3 and 4), as will be described below. In the closed loop system, a desired A/F ratio is compared to the estimated A/F ratio to determine an A/F error, as shown at blocks 96 and 98, respectively, of FIG. 5. The desired A/F ratio is determined according to a look-up table indexed by load and engine speed.

The PID gains of the PID controller are determined, as shown at block 100, and applied to the A/F error to obtain an A/F ratio correction factor, CF, as shown at block 102. The control parameters, proportional gain $K_p$ integral gain $K_i$, and derivative gain $K_d$, of the PID controller 94 were experimentally optimized for performance and robustness. In the preferred embodiment, robust values of 0.6, 0.5, and 0.1 are chosen for $K_p$, $K_i$, and $K_d$, respectively. The CF is then applied to the base fuel injection mass calculation, as shown at block 104, in order to bring the estimated A/F ratio close to the desired A/F ratio. That is, the base fuel injection mass is then corrected in accordance with the following: Corrected Base Fuel Injection mass=(Air Mass×CF)/(14.65×Lambda).

The present invention provides a sensorless method to infer, estimate and control A/F during engine operation at stoichiometric, rich, or lean A/F during engine cold start operation. The method relies on applying a small fuel pulse width modulation to the engine and synchronously measuring the effect of the modulation on related engine event periods. This effect is utilized in estimating A/F ratio, which is then compared to the desired A/F ratio. The difference between the estimated A/F ratio and the desired A/F ratio is used in controlling the A/F ratio to the desired A/F ratio.

While the best modes for carrying out the invention have been described in detail, those familiar with the art to which this invention relates will recognize various alternative designs and embodiments for practicing the invention as defined by the following claims.

What is claimed is:

1. A method for estimating air/fuel ratio of an internal combustion engine during engine cold start, the engine having a fuel injector for injecting fuel into the engine according to a base fuel pulse width, the method comprising:

sensing a cylinder air mass and generating a corresponding air mass signal;

modulating the base fuel pulse width to the fuel injector according to a predetermined monotonically decreasing event schedule based on the air mass signal, the schedule including a rich fuel pulse width relative to the base fuel pulse width and a lean fuel pulse width relative to the base fuel pulse width;

determining a rich event time in response to the rich fuel pulse width and a lean event time in response to the lean fuel pulse width; and determining the air/fuel ratio based on the rich event time and the lean event time.

2. The method as recited in claim 1 further comprising:

controlling the engine based on the determined air/fuel ratio.

3. The method as recited in claim 2 wherein controlling the engine comprises:

determining a desired air/fuel ratio based on a predetermined look-up table; and controlling the base fuel pulse width based on the desired air/fuel ratio and the determined air/fuel ratio.

4. The method as recited in claim 1 wherein modulating includes periodically alternating the rich pulse width and the lean pulse width about the base fuel pulse width.

5. The method as recited in claim 1 wherein the predetermined event schedule includes two rich pulse widths and two lean pulse widths.

6. The method as recited in claim 1 wherein determining the air/fuel ratio includes normalizing a difference between the rich event time and the lean event time to obtain a normalized difference.

7. The method as recited in claim 6 wherein determining the air/fuel ratio further includes determining a moving average for the normalized difference to obtain an averaged rich event time and an averaged lean event time.

8. The method as recited in claim 7 wherein determining the air/fuel ratio further includes determining a difference between the averaged rich event time and the averaged lean event time to obtain an averaged difference.

9. The method as recited in claim 1 wherein determining the air/fuel ratio includes determining the air/fuel ratio utilizing a regression analysis.

10. The method as recited in claim 1 wherein determining the air/fuel ratio includes determining the air/fuel ratio utilizing a neural network.

11. A system for estimating air/fuel ratio of an internal combustion engine during engine cold start, the engine having a fuel injector for injecting fuel into the engine according to a base fuel pulse width, the system comprising:

an air mass sensor for sensing a cylinder air mass and generating a corresponding air mass signal; and control logic operative to modulate the base fuel pulse width to the fuel injector according to a predetermined monotonically decreasing event schedule based on the air mass signal, the schedule including a rich fuel pulse width relative to the base fuel pulse width and a lean fuel pulse width relative to the base fuel pulse width, determine a rich event time in response to the rich fuel pulse width and a lean event time in response to the lean fuel pulse width, and determine the air/fuel ratio based on the rich event time and the lean event time.

12. The system as recited in claim 11 wherein the control logic is further operative to control the engine based on the determined air/fuel ratio.

13. The system as recited in claim 12 wherein the control logic, in controlling the engine, is further operative to determine a desired air/fuel ratio based on a predetermined look-up table, and control the base fuel pulse width based on the desired air/fuel ratio and the determined air/fuel ratio.

14. The system as recited in claim 12 wherein the control logic, in modulating the base fuel pulse width, is further operative to periodically alternate the rich pulse width and the lean pulse width about the base fuel pulse width.

15. The system as recited in claim 11 wherein the control logic, in determining the air/fuel ratio is further operative to normalize a difference between the rich event time and the lean event time to obtain a normalized difference.

16. The system as recited in claim 15 wherein the control logic, in determining the air/fuel ratio is further operative to determine a moving average for the normalized difference to obtain an averaged rich event time and an averaged lean event time.

17. The system as recited in claim 16 wherein the control logic, in determining the air/fuel ratio is further operative to determine a difference between the averaged rich event time and the averaged lean event time to obtain an averaged difference.

18. The system as recited in claim 11 wherein the control logic is further operative to determine the air/fuel ratio utilizing a regression analysis.

19. The system as recited in claim 11 wherein the control logic comprises a neural network to determine the air/fuel ratio.

20. An article of manufacture for an automotive vehicle having an internal combustion engine, a fuel injector for injecting fuel into the engine according to a base fuel pulse width, and an air mass sensor for sensing a cylinder air mass and generating a corresponding air mass signal, the article comprising:

a computer storage medium having a computer program encoded therein for modulating a base fuel pulse width to the fuel injector according to a predetermined monotonically decreasing event schedule based on the air mass signal, the schedule including a rich fuel pulse width relative to the base fuel pulse width and a lean fuel pulse width relative to the base fuel pulse width, determining a rich event time in response to the rich fuel pulse width and a lean event time in response to the lean fuel pulse width, and determining the air/fuel ratio based on the rich event time and the lean event time.

* * * * *